United States Patent [19]

Horiuchi

[11] 3,965,513

[45] June 29, 1976

[54] SECTIONAL BOAT STRUCTURES

[75] Inventor: Kotaro Horiuchi, Hamamatsu, Japan

[73] Assignee: Yamaha, Hatsudoki Kabushiki Kaisha, Japan

[22] Filed: Feb. 7, 1975

[21] Appl. No.: 547,929

[30] Foreign Application Priority Data

Feb. 9, 1974 Japan ..... 49-16665

[52] U.S. Cl. ..... 9/25; 114/77 R

[51] Int. Cl.[2] ..... B63B 7/04

[58] Field of Search ..... 9/1 R, 2 S, 2 R, 2 F; 114/77, 235 A, 235 R

[56] References Cited

UNITED STATES PATENTS 3,266,067 8/1966 Windle ..... 9/2 S

FOREIGN PATENTS OR APPLICATIONS 444,175 5/1927 Germany ..... 9/2 S 1,202,675 10/1965 Germany ..... 114/235 R

*Primary Examiner*—Trygve M. Blix
*Assistant Examiner*—Sherman D. Basinger
*Attorney, Agent, or Firm*—Stevens, Davis, Miller & Mosher

[57] ABSTRACT

A boat structure having interconnected front and rear body sections, said body sections being provided at mating end portions thereof with substantially U-shaped abutting peripheral edges which are in abutting engagement with each other when the body sections are assembled, the body sections being further provided at the mating end portions thereof with radially inwardly extending connecting members in the form of partition walls which are connected together at the center portions thereof by a single bolt and nut.

13 Claims, 4 Drawing Figures

SECTIONAL BOAT STRUCTURES

The present invention relates to boat structures having interconnected body sections. Particularly, the present invention pertains to interconnecting means for such boat structures.

In boat structures having a relatively slim and elongated body such as sculls, pedal boats and catamarans, it is desirable to constitute the body by interconnected front and rear sections so that the boat can readily be disassembled for transportation. Conventionally, in a wooden boat, it has already been known to divide the body into front and rear sections which are interconnected each other at mating ends by means of a plurality of bolts. The known structure is, however, disadvantageous in that the weight is unavoidably increased and assembling must be performed on a rigid working table. Further, since the interconnecting structure includes a substantial number of tightening bolts, increased time and labor are required in assembling the body sections.

The present invention has therefore an object to provide novel means for interconnecting two longitudinally divided body sections of a boat.

Another object of the present invention is to provide boat structures which is light in weight and can be readily disassembled for transportation and also readily assembled for use.

A further object of the present invention is to provide body section interconnecting means particularly suitable for plastic boat structures.

According to the present invention, the above and other objects of the present invention can be achieved by a boat structure having longitudinally extending body means which includes a first body section having a first mating end portion at its rear end, a second body section having a second mating end portion at its front end, said first and second body sections being provided at the respective mating end portions with abutting peripheral edge means which are in abutting engagement with each other when the body means is assembled, first connecting member means provided in the first body section and extending substantially radially inwardly from the peripheral edge means thereof, second connecting member means provided in the second body section and extending substantially radially inwardly from the peripheral edge means thereof, and means for connecting said connecting member means together. In preferable structure, one of the first and second connecting member means is inclined axially inwardly from the peripheral edge means of the associated body section, and the other connecting member means axially outwardly, the first and second connecting member means being connected by a single connecting bolt and a co-operating nut at substantially the centers of the connecting member means. According to a further feature of the present invention, each of said first and second connecting member means is constituted by a solid partition wall whereby water is prevented from entering the inside of the associated body section.

The above and other objects and features of the present invention will become apparent from the following descriptions of a preferred embodiments taking reference to the accompanying drawings, in which.

Figure 1:
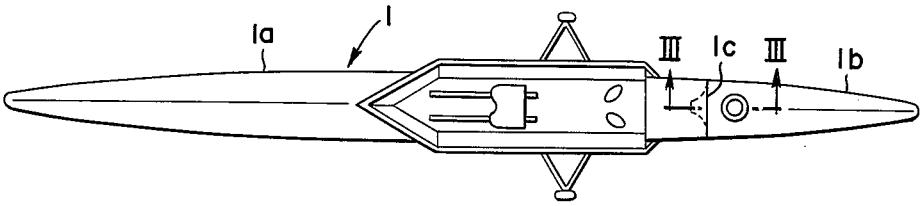
FIG. 1 is a top plan view of a scull embodying the features of the present invention.
Figure 2:
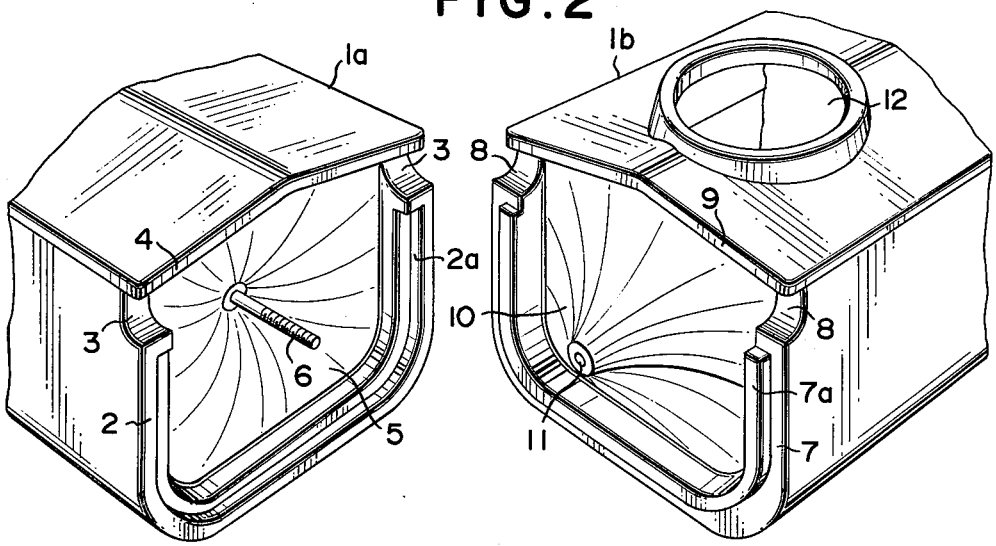
FIG. 2 is an exploded fragmentary view showing mating end portions of the scull body sections.
Figure 3:
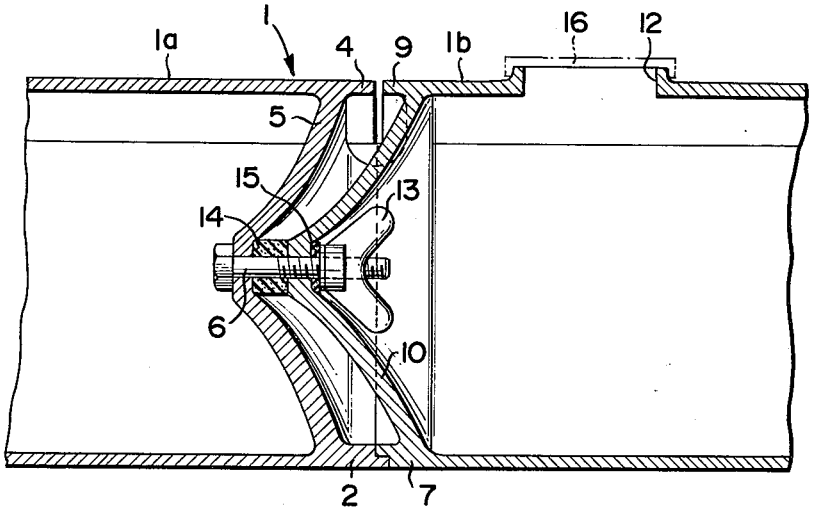
FIG. 3 is a fragmentary sectional view taken along the line III—III in FIG. 1.

Referring now to the drawings which show an example in which the present invention is embodied in a scull. The scull has a body 1 which is divided into a front section 1*a* and a rear section 1*b* which are interconnected at mating end portions 1*c*. FIGS. 2 and 3 show in detail the interconnecting structure of the body. The front body section 1*a* is provided at the rear end thereof with an abutting peripheral edge 2 of substantially U-shaped configuration. Above the upper ends of the U-shaped peripheral edge 2, there are provided relief grooves 3. Further, there is also formed a rearwardly extending flange 4 above the relief grooves 3. The peripheral edge 2 is provided along its radially inner edge with a cutout groove 2*a*. In the front body section 1*a*, there is further provided a partition wall 5 which is inclined forwardly from the periphery to the center of the body cross-section so as to constitute a connecting member according to the present invention. The partition wall 5 is provided at its center portion with a bolt 6 which is secured thereto.

Figure 4:
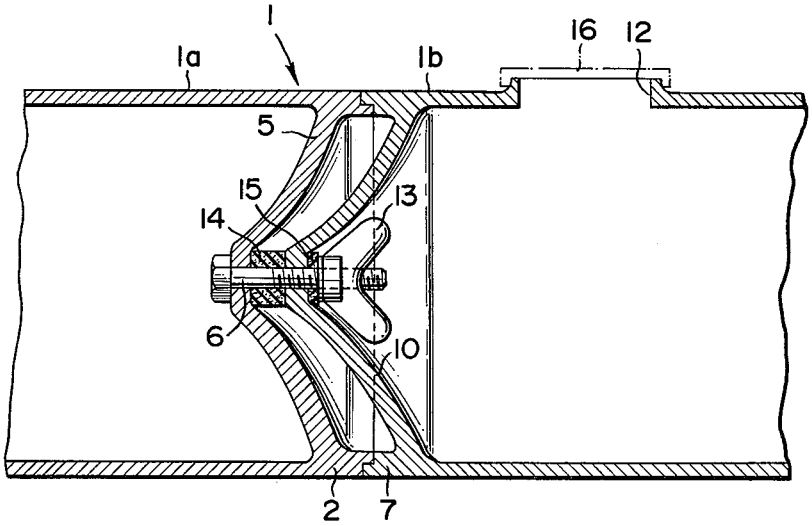
FIG. 4 is a sectional view similar to FIG. 3 but showing another embodiment of the present invention.

The rear body section 1*b* is provided at the front end thereof with an abutting peripheral edge 7 of substantially U-shaped configuration. The peripheral edge 7 is formed along its radially inner edge with a projection 7*a* for mating engagement with the cutout groove 2*a* of the peripheral edge 2 in the front body section 1*a*. Above the upper ends of the U-shaped peripheral edge 7, there are formed relief grooves 8 to define a forwardly extending upper flange 9. The rear body section 1*b* is further provided with a partition wall 10 which is axially forwardly inclined from the periphery to the center of the body 1. The partition wall 10 is formed with a hole 11 for receiving the bolt 6. The rear body section 1*b* is formed at the upper wall with an access hole 12. Therefore, the body sections 1*a* and 1*b* can be assembled by inserting the bolt 6 into the hole 11 and tightening a butterfly nut 13 on the bolt 6 with the peripheral edges 2 and 7 in abutting engagement with each other. Preferably, sealing members 14 and 15 are disposed around the bolts. The access hole 12 may be covered by a closure 16. In the illustrated structure, the partition walls 5 and 10 have slightly concave longitudinal sectional configurations as clearly shown in FIG. 3. It has been found that the configurations of the illustrated partition walls 5 and 10 are preferable from the viewpoint of structural strength. It has also been found that the axial offset H of the center of the partition wall 5 or 10 from the periphery thereof should preferably be between 0.3 and 0.6 times the diametrical dimension D of the body section from the viewpoint of strength and manufacture. It is of course possible and within the scope of the present invention to form the peripheral edges 2 and 7 throughout the periphery of the doby cross-section as shown in FIG. 4. In such a structure, a problem may arise in maintaining each abutting edge in a plane, but additional strength can be ensured at the abutting edges. The structure illustrated in FIGS. 2 and 3 is preferable in that the flatness of the abutting edges can readily be ensured. It should further be noted that the peripheral abutting edges 2, 7 may not be of a continuous form but they may intermittently extend along the peripheries. The present invention can of course be applied to a boat structure having a body which is divided into more than two body sections.

According to the present invention, the body of the boat can be easily and quickly assembled by tightening only a single or a limited number of bolts. Further, positive and secure connection can be ensured through effective utilization of the resiliency or elasticity of the material. When the radially inwardly extending connecting members are formed by solid partition walls 5 and 10 as in the illustrated embodiment, it is possible to effectively prevent water from entering the inside of the body of the boat.

The invention has thus been shown and described with reference to a specific embodiment, however, it should be noted that the invention is in no way limited to the details of the illustrated structures but changes and modifications may be made without departing from the scope of the appended claims.

I claim:

1. A boat structure having longitudinally extending body means which includes a first body section having a first mating end portion at its rear end, a second body section having a second mating end portion at its front end, said first and second body section having at the respective mating end portions abutting peripheral edge means which are in abutting engagement with each other when the body means is assembled, said abutting peripheral edge means on the first and second body sections having mutually engagable groove means and projection means, first connecting member means in the first body section and extending substantially radially inwardly from the peripheral edge means thereof, second connecting member means in the second body section and extending substantially radially inwardly from the peripheral edge means thereof, said first and second connecting member means being axially offset from the abutting peripheral edge means in the first and second mating end portions, respectively, so that the first and second connecting member means are spaced from each other when the abutting edge means of the first and second mating end portions are put into abutting engagement with each other, and means for connecting said connecting member means together.

2. A boat structure in accordance with claim 1 in which said connecting means is a bolt secured to one of said first and second connecting member means, and a nut for engagement with the bolt.

3. A boat structure in accordance with claim 1 in which one of the first and second connecting member means is inclined axially inwardly from the peripheral edge means of the associated body section, and the other connecting member means axially outwardly, the first and second connecting member means being connected by a single connecting bolt and a cooperating nut at substantially the centers of the connecting member means.

4. A boat structure in accordance with claim 3 in which each of said connecting member means is of concave longitudinal sectional configuration.

5. A boat structure in accordance with claim 3 in which the axial offset of the center of each connecting member means from the periphery thereof is between 0.3 and 0.6 times the diametrical dimension thereof.

6. A boat structure in accordance with claim 1 in which each of said first and second connecting member means comprises a solid partition wall whereby water is prevented from entering the inside of the associated body section.

7. A boat structure having longitudinally extending body means which includes a first body section having a first mating end portion at its rear end, a second body section having a second mating end portion at its front end, said first and second body sections having at the respective mating end portions abutting peripheral edge means which are in abutting engagement with each other when the body means is assembled, said abutting peripheral edge means on the first and second body sections being of substantially U-shaped configuration, relief grooves formed above the upper edges to define longitudinally extending upper flanges above the relief grooves, first connecting member means in the first body section and extending substantially radially inwardly from the peripheral edge means thereof, second connecting member means in the second body section and extending substantially radially inwardly from the peripheral edge means thereof, said first and second connecting member means being axially offset from the abutting peripheral edge means in the first and second mating end portions, respectively, so that the first and second connecting member means are spaced from each other when the abutting edge means of the first and second mating end portions are put into abutting engagement with each other, and means for connecting said connecting member means together.

8. A boat structure in accordance with claim 7 in which said connecting means is a bolt secured to one of said first and second connecting member means, and a nut for engagement with the bolt.

9. A boat structure in accordance with claim 7 in which said abutting peripheral edge means of the first and second body sections are provided with mutually engagable groove means and projection means.

10. A boat structure in accordance with claim 7 in which one of the first and second connecting member means is inclined axially inwardly from the peripheral edge means of the associated body section, and the other connecting member means axially outwardly, the first and second connecting member means being connected by a single connecting bolt and a co-operating nut at substantially the centers of the connecting member means.

11. A boat structure in accordance with claim 10 in which each of said connecting member means is of concave longitudinal sectional configuration.

12. A boat structure in accordance with claim 10 in which the axial offset of the center of each connecting member means from the periphery thereof is between 0.3 and 0.6 times the diametrical dimension thereof.

13. A boat structure in accordance with claim 7 in which each of said first and second connecting member means comprises a solid partition wall whereby water is prevented from entering the inside of the associated body section.

* * * * *